United States Patent [19]

Nichols, Jr.

[11] Patent Number: 4,622,043

[45] Date of Patent: Nov. 11, 1986

[54] TEXTILE DYEING PROCESS: MULTICOLOR PATTERN DYEING OF TUFTED NYLON CARPET

[75] Inventor: David B. Nichols, Jr., Dalton, Ga.

[73] Assignee: RCA Corporation, Princeton, N.J.

[21] Appl. No.: 916,903

[22] Filed: Jun. 19, 1978

[51] Int. Cl.[4] ..... D06P 5/00

[52] U.S. Cl. ..... 8/485; 8/478; 8/680; 8/924; 8/929

[58] Field of Search ..... 8/1 XB, 14, 15, 25, 8/478, 485

[56] References Cited

U.S. PATENT DOCUMENTS

| | | | |
|---|---|---|---|
| 545,420 | 8/1895 | Bamford | 8/1 XB |
| 617,772 | 1/1900 | Rettig | 8/14 |
| 790,718 | 5/1905 | Bucher | 8/14 |
| 1,210,279 | 12/1916 | Diener | 8/14 |
| 1,579,872 | 4/1926 | LecJaky | 8/14 |
| 1,754,287 | 4/1930 | Shoemaker | 8/14 |
| 2,002,848 | 5/1935 | Cohen | 91/68 |
| 2,090,890 | 8/1937 | Howard et al. | 8/5 |
| 2,313,726 | 3/1943 | Atwell | 260/20 |
| 2,321,974 | 6/1943 | Bird | 8/14 |
| 2,359,776 | 10/1944 | Milne et al. | 8/65 |
| 3,220,793 | 11/1965 | Parsons et al. | 8/14 |
| 3,414,368 | 12/1968 | Kitamura et al. | 8/64 |
| 3,468,694 | 9/1969 | Moritz et al. | 8/15 |
| 3,669,611 | 6/1972 | Shimauchi et al. | 8/14 |
| 3,756,770 | 9/1973 | Kahayushi et al. | 8/14 |
| 3,945,791 | 2/1976 | Buhrn | 8/14 |
| 3,963,428 | 6/1976 | Stark | 8/1 XB |
| 4,000,964 | 1/1977 | Newton | 8/14 |
| 4,010,709 | 3/1977 | Sayman et al. | 8/1 XB |
| 4,146,362 | 3/1979 | Nichols | 8/485 |
| 4,189,302 | 2/1980 | Toland | 8/480 |

FOREIGN PATENT DOCUMENTS

| | | | |
|---|---|---|---|
| 763022 | 7/1971 | Belgium | 8/1 XB |
| 2147972 | 3/1973 | Fed. Rep. of Germany | 8/14 |
| 2148871 | 5/1973 | Fed. Rep. of Germany | 8/62 |
| 4540716 | 12/1977 | Japan | 8/14 |
| 490532 | 8/1938 | United Kingdom | 8/65 |
| 740291 | 11/1955 | United Kingdom | 8/65 |
| 1243403 | 8/1971 | United Kingdom | 8/14 |
| 1363129 | 8/1974 | United Kingdom | 8/14 |

OTHER PUBLICATIONS

Dawson, Jour of Soc. of Dyers & Colorists, vol. 90, pp. 235–238, Jul. 1974.

Wigfall, S. Textile Colorist Apr. 1944, pp. 170–173.

Amer. Dyestuff Reporter (ADR) Jul. 23, 1951, p. 478.

ADR Jun. 1971, pp. 25–31, Leifeld, G.

German Publ. *Kusters* 1973.

Hall, A. The Standard Handbook of Textiles.

*Primary Examiner*—A. Lionel Clingman

*Attorney, Agent, or Firm*—Joseph S. Tripoli; George E. Haas; William Squire

[57] ABSTRACT

A continuous process for dyeing a pre-wetted carpet includes the step of printing, in one dye color, a desired pattern on the tufts, compressing those of the tufts receiving the dye in the process. The tufted printed surface of the carpet is then covered with a viscous water-soluble first gum and drops of a second dye, which is less viscous than the first gum, over the viscous gum-wetted tufts. Drops of a water-soluble second gum which is less viscous than the first gum, are then applied to the tufted surface and then a third dye which is substantially less viscous than the second dye is applied over the entire tufted surface of the carpet.

12 Claims, 8 Drawing Figures

TEXTILE DYEING PROCESS: MULTICOLOR PATTERN DYEING OF TUFTED NYLON CARPET

The present invention relates to a continuous process for dyeing tufted textiles which is particularly suitable for carpeting.

TAK dyeing, which is a relatively recent development in the carpet industry, is a continuous dyeing process in which dye is deposited, in drops, on the tufted side of the carpet. A wide variety of dye colors may be employed and different random color patterns obtained. Typical apparatuses which may be used for applying the dyes in drops are disclosed, for example, in U.S. Pat. Nos. 3,683,649; 3,800,568; 3,726,640; 3,731,503; 3,964,860; and 4,010,709.

The ever-changing tastes of the public places a continuous demand on the carpet industry for new styles which are both pleasing and attractive. In my copending application Ser. No. 661,396, filed Feb. 25, 1976, now abandoned, I describe a method and apparatus, now in wide use, for producing one group of such styles. In this method a layer of a liquid, such as a water soluble gum, is applied to the tufted surface of the carpeting and then drops of dye(s) are applied to the gum-wetted tufts. The dye or dyes spread, blend, attenuate and provide, in the finished product, randomly varying patterns with gentle shading effects, which are pleasing to the eye.

I describe a second dyeing technique in my copending application Ser. No. 851,418, filed Nov. 14, 1977 now U.S. Pat. Nos. 4,146,362. Here, a relatively viscous first dye is deposited, for example, in drops onto spaced regions of a textile and a less viscous second dye is then deposited onto regions of the textile which include the spaced regions. The first dye colors the regions of the textile it reaches in the first dye color and masks these regions from the second dye. The second dye colors the regions of the textile it reaches in the second dye color and does not substantially affect the regions of the carpet masked by the first dye. This process provides additional new and pleasing coloring effects; however, the market continually demands other pleasing styles.

In a process embodying the invention for dyeing a textile, a relatively viscous first liquid, such as a water soluble gum, is deposited over a first region of the material. A first viscous dye is deposited on spaced second regions of the material, including the first regions. A second viscous liquid such as a water soluble gum is then deposited on spaced third regions of the material which includes the first region and may include the spaced second regions. Then a second dye substantially less viscous than either the first dye or the first and second liquids is applied to regions which include the first, second and third regions.

Figure 1:
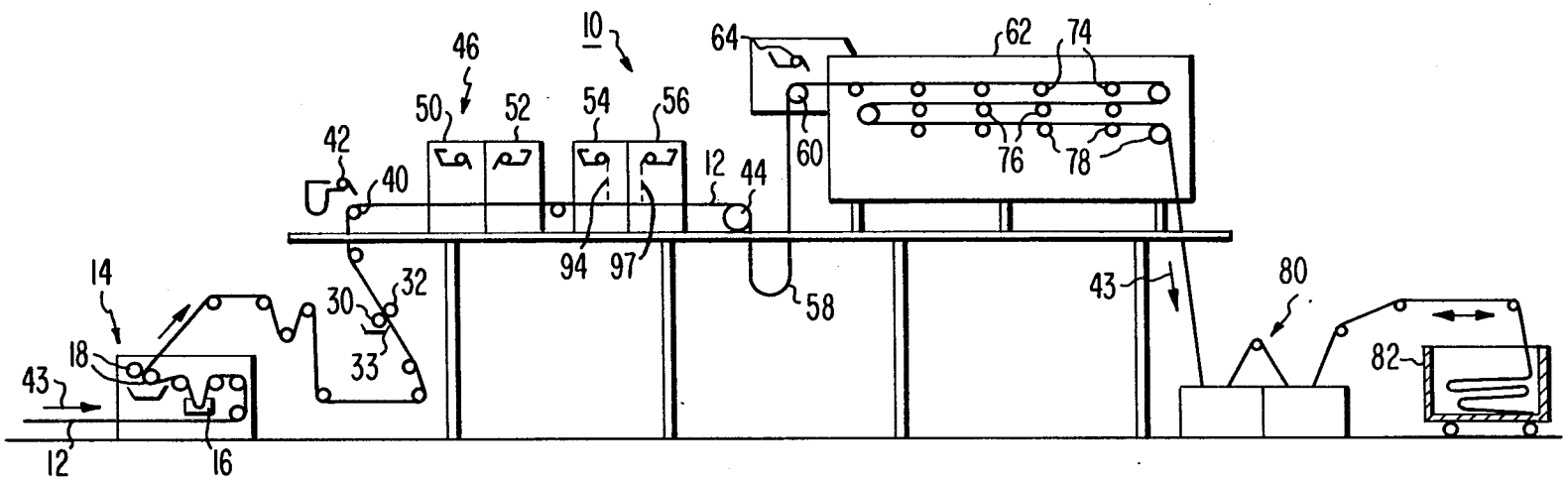
FIG. 1 is a schematic, side-elevational view of a carpet dyeing apparatus used to practice the process embodying the present invention.

The apparatus shown in FIG. 1 is particularly suitable for dyeing carpeting but may be used on woven or flocked textiles providing there is some pile height. Preferably, this pile height should be at least about $\frac{1}{4}$ inch. Carpeting 12 is fed from a supply roll (not shown) through a pad machine 14. Machine 14 includes a reservoir 16 containing a pre-wet solution through which the carpet passes. The carpet is then conveyed through two squeeze rollers 18 which remove sufficient pre-wet solution from the carpet tufts to provide a desired percent liquid "pick-up." The squeezing action tends to lay the tufts over. The expression "percent pick-up" is a measure of the weight of the liquid in a given area of the carpet and in particular is the ratio of the weight of liquid in the given area of the carpet to the dry weight of that same area of carpet multiplied by 100.

The pre-wet solution in the reservoir 16 is heated to an elevated temperature of 135° F. This elevated temperature relaxes the yarns and increase their ability to assume any position in which they are placed. That is, it tends to remove some of the pre-stresses in the yarn and permits them to be oriented easily. The relaxation of the yarns by the raised temperature of the pre-wet solution helps to retain the yarns in the folded-over position after the pad squeezing.

Figure 8:
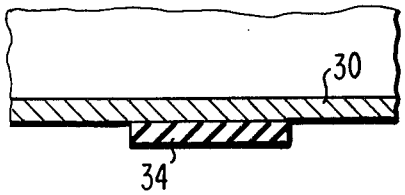
FIG. 8 illustrates a section elevational view of a print roller used in the apparatus of FIG. 1.

After leaving the machine 14, the carpeting 12 passes between a print roller 30 and a back-up roller 32, as shown in FIG. 1. The roller 30 comprises a cylinder with a plurality of printing pads, which may be made of hard rubber and which may have grooves formed in their printing surface, secured to the surface of the cylinder in a desired pattern. One such pad is shown at 34 in FIG. 8. (In an alternative arrangement, the print roller may comprise a cylinder with cut outs in the surface thereof.)

The rollers 30 and 32 extend across the entire breadth of the carpeting 12. The roller 30 is immersed in a first dye bath reservoir 33, for printing the desired pattern. This first dye, in reservoir 33, is slightly viscous, for example, it may be about 200 centipoise (CPS) and is in a first color ("color 1"). As the carpeting 12 passes between rollers 30 and 32, the pads 34 dye the tufts at regions 36*a–e* (FIG. 3), compressing the tufts in these regions and causing them to bend over. Because of variations in density of the tufting, length of the particular tufts and possibly other factors, some tufts which have been printed may be bent over more than others which have been printed when they leave the print roller region. This is acceptable.

The first dye also tends to help retain the printed tufts in the folded orientation due to its viscosity. Thus the printed tufts may be slightly more bent than the non-printed tufts.

The carpet web then advances upwardly and around roller 40, FIG. 1 and past a viscous liquid applicator 42. An applicator of this type is described in detail in my copending application Ser. No. 661,396, filed Feb. 25, 1976. In the present process the applicator 42 applies a sheet of colorless viscous gum to the tufted face of the carpet over the entire width of the carpet web. This gum is a water base vegetable gum solution which is chemically inert with respect to later applied dyes. Chemically inert implies that there is no chemical reaction between the gum and the dye. The carpet web is oriented horizontally at this point. The web of carpeting is then pulled horizontally over guide rollers by drive roller 44 through machines 46 and 48.

Machine 46 comprises two identical, separate drop dispensing applicators 50 and 52 which are opposite and facing each other. Machine 48 also comprises two separate and independent identical drop dispensing applicators 54 and 56. Machine 48 has the capability of dispensing drops (or streams) of a liquid in a zig-zag pattern over spaced areas 39 *a–e* and 41 *a–e*, FIG. 4 and is sometimes referred to as a multi-TAK machine. For purposes of the following discussion, "drops" will be referred to by way of example but it is to be understood that this is intended to be generic to drops, streams and so on. Applicator 54 applies patterns 39 *a–e* and applicator 56 applied patterns 41 *a–e*. Note in FIGS. 1 and 3 that the direction of carpet movement is as indicated by arrow 43.

The machine 46, on the other hand, is capable of dispensing drops (or streams) of liquid randomly over the entire tufted face of the carpet and is referred to as a TAK machine. A machine similar to machine 48 is illustrated in U.S. Pat. No. 3,964,860 and a machine similar to machine 46 is described in U.S. Pat. No. 4,010,709.

The carpet material is then conveyed downward into a tension compensating loop 58 and then upward to an elevation above the level of the carpeting 12 in the machines 46 and 48, to roller 60. The web of carpeting traverses around roller 60 beneath dye applicator 64. The latter, which is of conventional construction, is sometimes known as a Kusters applicator. Dye applicator 64 applies a continuous sheet or layer of dye to the tufted surface of the carpeting, over the entire width of the carpeting. In the application region, the carpeting is horizontally oriented.

Figure 2:
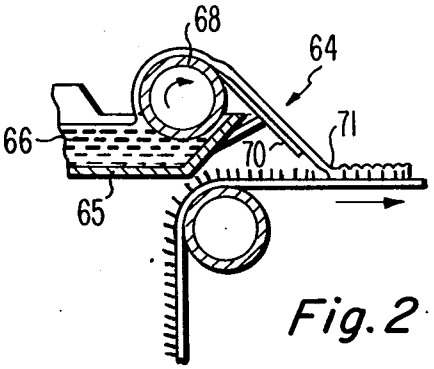
FIG. 2 is a side-elevational view of a portion of the apparatus of FIG. 1.

FIG. 2 illustrates a portion of the dye applicator 64. It includes a pan 65 for receiving a dye 66 and a roller 68. The roller picks up a layer of the dye from reservoir 66 and this layer is brought into contact with the edge of doctor blade 70. The latter peels a sheet 71 of the dye away from the roller and delivers it to the tufted surface of the carpet. The gum applicator 42 includes similar structure; however, a special set of input ports is employed to insure that the viscous gum will be of uniform height, as explained in my copending patent application No. 661,393.

The carpet enters the steamer 62 after it passes the applicator 64. The steamer includes a first set of rollers 74 for transporting the carpet in a first horizontal pass in the steamer, a second set of rollers 76 for transporting the carpet in a second horizontal pass in the steamer, this one with the tufts pointing downward, and a third set of rollers 78 for transporting the carpet in a third horizontal pass in the steamer.

The carpet exits the steamer in a substantially downward direction and passes into a washing apparatus 80. The latter has two compartments for washing the carpet and for removing unfixed dye, gum and chemicals from the carpet. The gum viscosity is lowered in the steamer 62 as a result of being heated and is readily removed in the washing apparatus. The remaining excess elements also are readily removed. The washed carpet passes into a suitable container 82 and is later transported to and dried in a drying machine (not shown).

In carrying out the process of the present invention, reservoir 16 in the pad machine 14 is filled with a suitable pre-wet solution formed of water, surfactant, fabric softener, water softener, and a defoamer, heated as described above and having a pH of about 7. The pH of the bath in reservoir 16 affects what occurs in the steamer. If the pH is alkaline, it serves to slow down the fixation of the dyes in the steamer, this may allow them to wick down to the tuft tips more than desired (for purpose of creating a particular dyeing effect) during the second horizontal pass. In the present process, the desired effect is obtained by making the pH of the bath in reservoir 16 neutral or somewhat acid. This helps neutralize the subsequently applied liquids to prevent fixing prior to the steamer. This also allows blending of some of the later applied colors as will be explained. The carpet after being squeezed to the desired percent pickup, is printed by roller 30. The pre-wet pickup is preferably 130–140 percent.

The color 1 printing dye is relative acidic (it is at a pH of about 3) to insure the pattern which is printed on the carpet by roller 30 fixes relatively quickly in the steamer. It is desired that the printed tufts remain colored with color 1 throughout the process, to ensure its effectiveness as a background color. This color is printed in about the upper third tip portion of the tufts. In the finished product, the portion of the overall pattern in the color 1 dye does not dominate the design and this is desired. The printing dye adds additional liquid to the printed tufts. This results in a cumulative wet pickup of about 220–240 percent in the printed portion of these tufts. Color 1 may have a viscosity in the range of50–1200 CPS. The desired effect determines the viscosity. The lower the viscosity, the more subtle the effect, i.e., increased muting of color 1. The higher viscosity in the range therefore provides a more predominate, stronger coloring of the tufts.

The sheet of relatively viscous colorless gum 72 (or other suitable liquid carrier) applied to the face of the carpeting preferable has a viscosity of about 1800 CPS but can lie within a range of about 600–5000 CPS. This sheet of gum may be about a quarter of an inch thick and is of uniform thickness when applied across the entire face of the carpet.

The gum applied to the carpet tends to sink into the spaces between the tufts and to coat varying portions of the tufts, as will be discussed in detail later. The depth to which the gum penetrates will vary at different parts of the carpet. In general, the viscosity of the gum is sufficiently high that it does not sink all of the way to the carpet backing, although this may occur in isolated small regions.

In the present process, the machine 46 for applying drops of liquid is not in use and there is a relatively long distance between the applicator 42 and the first drop applicator 54. In one example, this distance is roughly 12½ feet. The carpet traverses this distance in about 25 seconds. A gum viscosity of 1800 CPS is found, in practice, to provide an average depth of gum penetration into the regions of carpeting of approximately 30 to 40 percent. This produces one kind of effect in the finished product. Lower gum viscosities permit deeper average gum penetration and higher gum viscosities shallower average penetration for different effects in the finished product for a given tufting density, lay of tufts, and time for penetration. The distance traveled affects the depth of gum penetration by affecting the time the gum is permitted to penetrate. The viscous gum may be made from any suitable vegetable base as described in the aforementioned copending patent application No.

651,396. The gum base is mixed with a defoamer, a preservative and acetic acid to provide a slightly acidic solution having a pH preferably in the range of 5.5–6.

The applicator 54 contains a second dye in a particular color (color 2). This dye may have a viscosity of about 600 CPS, in this example. This viscosity may also be within a range of 600 to 1200 CPS. The dye formulation is conventional. Dyes suitable for use with nylon carpeting are preferably water soluble acid dyes. In general, the dye may be formulated by mixing a number of different primary color dyes to form the desired color shade. The dye is selected to be compatible with the particular synthetic, natural or mixtures of fibres in the particular tufts being dyed.

The reservoir of drop applicator 56 contains a second water soluble gum, call it gum 2, mixed with a wetting agent, a water softener, formic acid, a defoamer agent and water having a combined viscosity which is substantially lower than that of the gum applied by applicator 42. If the latter gum has a combined viscosity of 1800 CPS, the combined viscosity of the gum applied by applicator 56 may be 600 CPS and its pH may be 3. This viscosity could also be within the range of 600 to 1200 CPS and, as already mentioned, will be lower than that of the sheet of gum.

The pH of any gum used in the process is significant. The higher the pH of the gum, the less the dye exhausts in the regions of the tufts coated with or saturated by the gum, that is, when the carpet reaches the steamer very little of the acid dye will fix to the tufts covered or saturated by a substantially higher pH gum. For example, if the pH of gum 2 were very high, say 10.5, a minimum amount of the acid dye (say of pH 3) would fix to this tuft. In practice, gum 2 may have a pH of 3, as an example, and this does have an effect in increasing the ability of a later applied dye to fix to a tuft coated with this gum.

There are a number of factors which must be considered in choosing the viscosity of the gum 2. The viscosity must be sufficiently high that it masks those tufts or the portions of the tufts the gum 2 reaches from the lower viscosity later Kusters applied dye (applied at 64). For a Kusters applied dye (dye 2) at a viscosity of about 30, the gum 2 should have a viscosity of at least about 600 CPS to carry out this function. The higher the viscosity of gum 2, the greater its shielding effect, for a given dye viscosity. The viscosity of gum 2 also should be sufficiently low so that the drops of gum 2 readily can penetrate into (and through) the sheet of gum 1 (applied at 42). For a gum 1 viscosity of 1800 CPS, the gum 2 viscosity should not be higher than about 1200 CPS. If the gum 1 viscosity is greater than 1800 CPS, then the gum 2 viscosity can be greater than 1200 CPS; similarly, if the dye 2 viscosity is lower than 30 CPS, the gum 2 viscosity can be lower than 600 CPS. The lower the viscosity of gum 2, the quicker the penetration gum 2 through gum 1, for a given gum 1 viscosity, all other things being equal. Within the range specified different viscosities chosen for gum 2 will cause different dyeing effects, generally in subtle ways.

Figure 3:
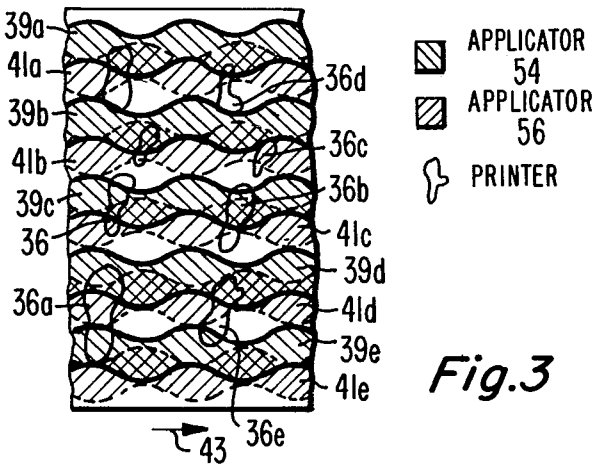
FIG. 3 illustrates some of the patterns produced by the apparatus of FIG. 1.
Figure 4:
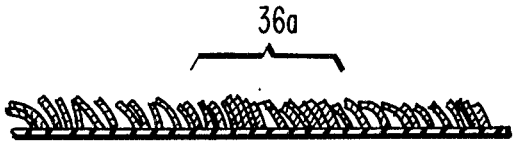
FIGS. 4 and 5 are fragmentary cross-sectional views taken through the carpet.

Applicators 54 and 56 dispense their respective liquids in drops and the drops are confined to the spaced areas 39*a–e* and 41*a–e*, respectively, shown in FIG. 3. In the particular design illustrated, the dye drops produced by applicator 54, fall on regions 39*a–e* which are spaced from one another by intermediate regions which are not reached directly by the drops (although there may be some splashing). The gum drops produced by applicator 56 form a similar type of pattern in regions 41*a–e* which are spaced from one another. However, the patterns 39 and 41 produced by applicators 54 and 56, respectively, may or may not overlap entirely or partially. Some of the individual drops 97 dispensed by the applicator 56 may fall on some of the same tufts as the drops 94 dispensed by the applicator 54 and other of the respective drops will reach different tufts.

The reservoir of applicator 64 is filled with a third dye in another shade or color, call it color 3, which has a substantially lowerviscosity than the color 2 dye. For example, if the color 2 dye has a viscosity of 600 CPS the color 3 dye may have a viscosity of from 30–60 CPS, but could vary from this somewhat to achieve its desired effect, as will be explained.

While the dyes disclosed herein are water soluble acid dyes, for use on nylon yarns, it should be understood that other yarn material, and also other types of dyes that are suitable for these other material may be used instead.

Each of the dyes may be prepared and selected from available colors in the manner described in detail in the aforesaid copending patent application No. 851,418, filed Nov. 14, 1977. The pH of the three dyesused are acidic (they may have a pH of 3 or so) so that the dyes will fix relatively quickly in the steamer 62. This pH is not critical and could vary. In one particular process it is estimated that about 90–95 percent of the dyes become fixed during the first horizontal pass of the carpet within the steamer 62. The remaining dye may wick down the tufts when upside down in the steamer during the second pass and color the tuft tips with a light shade of color 3 dye. In this process, the carpet traverses each pass somewhat more than one minute to achieve this affect.

Figure 5:
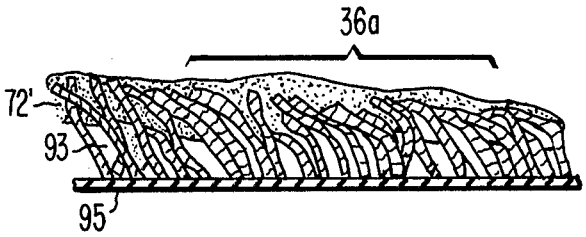
Figure 6:
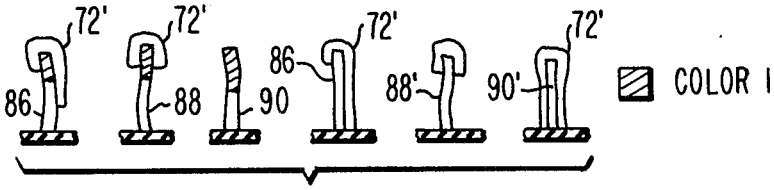
FIG. 6 illustrates the condition of some of the yarn tufts after the viscous liquid is applied to the carpet face.
Figure 7:
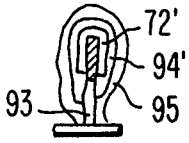
FIG. 7 illustrates a carpet tuft receiving various dyes and liquids applied in different steps in the process.

The various steps in the dyeing process are illustrated in FIGS. 5–7. FIG. 5 shows the gum 72 applied by the applicator 42 after the carpet has moved a distance from the point of application of the gum and before this section of the carpet has reached applicator 54. The gum coating 72' penetrates into the carpet tufts to an average depth of 30–40 percent or so as discussed above. However, in some areas, such as at 93, depending on the density of the tufts and the lay of the tufts, the penetration may be more, even to the backing 95. In the compressed areas 36*a* with the tufts laying over and printed, the density of the tufts and the volume of liquid in these tufts is higher than the non-printed areas. The film of viscous gum 72', therefore, penetrates more slowly. Because some of the tufts may be upright, or more loosely packed, some of the gum may penetrate more deeply.

Coatings on typical ones of the fibers of FIG. 5 are shown in FIG. 6. One tuft 86 is coated on the tip and on 80 percent of only one side by the gum coating 72'. This tuft was printed on the upper third with color 1. Another tuft 88 also is printed on the upper third in color 1 and is coated only at its tip by coating 72'. A third tuft 90 printed on the upper third with color 1, has not received any gum at all. This tuft may have been protected by other overlying tufts. Tuft 86' is coated with gum 72' similarly to tuft 86 but not dyed by the printer. Tuft 88' is coated with gum 72' similarly to tuft 88 but is not printed in color 1. Tuft 90' is coated with gum 72' completely as it may have been upright and not printed. Other, less numerous tufts (not shown) printed in color 1 may be fully coated with gum or with spots or flecks of gum and, of course, there are many other examples of gum coated and color 1 dyed tufts which are not illustrated.

As the carpet traverses beneath the applicator 54, drops 94 of the second dye fall onto the carpet face. As a result of the force of gravity, the drops 94 tend to penetrate through the gum 1 applied by applicator 42. Where the tufts are upright, the color 2 dye may penetrate deeply, in some cases 100 percent, that is, to the backing. Where the tufts have been compressed and bent over, that is, where they have been printed in the color 1 dye, the color 2 drops generally do not penetrate through the gum 72' coating as deeply as where the tufts are upright or less densely packed and have a lower wet pick-up.

Due to the greater volume of liquid in the printed areas (because these tufts are compressed and because these tufts have absorbed the color 1 dye) the tufts in these areas do not absorb the dye from applicator 54 as readily as tufts outside the printed area. Thus, those tufts printed with the color 1 dye tend to remain dyed more strongly in color 1 than in color 2, even after being in contact with the color 2 dye. The effect, with areas printed in color 1 and receiving also color 2 is a muting and blending of these two colors, generally with the color 1 predominating in the final color, but with a pleasing gradation of colors in the finished pattern.

The drops of color 2 dye may "swim" in the gum on top of the printed (and compressed and bent over) tufts for a relatively long period of time. As the material is transported, some of the color 2 reaches the tufts and colors them and other of this dye remains suspended in the gum over the tufts. In the steamer, when the gum loses its viscosity, the color 2 dye which is "swimming" in the gum may reach the printed tufts and dye them as well.

After the carpet 12 receives the color 2 dye drops 94, it travels beneath gum 2 applicator 56. Gum 2 has less effect on the printed tufts than on the non-printed ones as the former are more compressed and more saturated with pre-wet, gum 1, color 1 and color 2 dyes than the latter. The gum 2 produces a frosted whitish look on some carpet tips. This occurs in the areas where these tufts receive gums 1 and 2 but no colors 1 and 2. Due to the force of the their fall, the drops of gum 2 may pass through the tufts in the printed areas and reach the tuft bases. Assuming the base is uncolored, this gum will protect the base of the tuft from dye applied later by applicator at 64, so that the finished tuft will be colorless at its base (assuming the carpet to be undyed originally). The drops of gum falling on non-printed tufts may fall either on tufts dyed in color 2 (entirely or partially) or may drop on undyed tufts. In the former case, gum 2 will lighten any color 2 area it reaches while in the latter the gum will protect the part of the tuft it covers from the dye from applicator 64 and will cause the finished tuft to be substantially undyed. Due to the low dye pH's, there is relatively little bleeding or wicking action of the dyes in the steamer. Thus, in the printed areas, the drop applied dyes will dye the tufts a strong color 1, mostly at the tips. The 220–240 percent pick-up of pre-wet and print liquid minimizes absorption of the dye drops into the printed tufts. In the non-printed areas, the dye drop, color 2, can penetrate more readily into tufts. The drops of gum may slightly lighten the color of the previously print dyed tufts. The drops of gum 2 have their greatest effect on the non-printed tufts due to the lower volume of liquid on those tufts.

FIG. 7 illustrates a printed tuft 93 which is coated with gum 1 (shown at 72') at its tip. This gum may penetrate the tuft as well as coat the tuft. A drop 94' of color 2 dye, coats about 75 percent of the tuft, this drop having randomly fallen on this tuft. Color 2 penetrates this tuft 93 more slowly than it would a non-printed tuft due to the liquid saturation of tuft 93. A drop of gum 2 forms a coating 95 over the other coatings, this drop having randomly landed on the tuft. Due to the previously applied liquids, the coating 95 of gum 2 has little effect. On an unprinted tuft which has received a color 2 dye drop, a drop of gum 2 may displace or dilute some of color 2. While the layers in FIG. 7 are shown separate, they may in fact co-mingle and penetrate into the tufts.

After receiving the gum 2 drops, the web material traverses around roller 44 into loop 58 around roller 60 to dye applicator 64. The latter applies sheet 71 of the low viscosity dye in a particular color, call it color 3, over the tufted surface of the carpet web. The portions of the tufts coated with dyes or gums are masked from the color 3 dye and the remainder of each tuft becomes dyed in color 3. Thus, the base regions of most tufts are dyed in color 3 because the gums and previous dyes did not reach these base regions. The tufts which were protected by other tufts over them and which received neither previously applied gums or dyes become dyed in their entirety in color 3. These are relatively few in number and occur at isolated spaced regions in the finished pattern.

Where gum 2 coats an unprinted tuft which did not receive any of color 2 this tuft remains substantially white or undyed. Where gum 2 coats a tuft not printed but dyed with color 2, color 2 is lightened slightly by gum 2; where gum 2 coats a tuft printed with color 1 but not coated with color 2, color 1 is slightly lightened in shade but not as much as the tuft with color 2 due to the greater saturation of this tuft. In addition, there are various other more isolated combinations of coloring effects as different portions of different tufts receive flecks or spots of one or more dyes and gum. That is, some tufts have spots of color on a mainly white background while other tufts have white or light spots on a colored background.

Whiteish patterned areas are present due to the gum drops. Some tufts in these areas are almost uncolored and others only flecked with spots of color. The drop color 2 is present on the tips of some tufts and predominately colors other adjacent tufts to their bases. The carpet appears to have patterned areas of almost whiteish uncolored patches, background printed areas, patterned deep shades of color 3 and patterned color 2. All of the colors appear to blend together gradually. The overall effect is one of isolated deeply shaded areas in an overall more lightly colored carpet. Substantially, undyed tufts, which are relatively few in number, also provide an interesting contrasting effect with the remaining tufts most of which are in multiple colores and shades.

While particular drop applicators have been described, the manner of applying gum 2 and color 2 may vary from that shown as long as these are applied in spaced regions of the carpet, rather than to all of the tufts. The gums and high viscosity dye act as a shield to the low viscosity color 3 dye and it may be applied right over the gums and the color 1 and 2 dyes in the manner described The following are specific examples of processes embodying the present invention:

EXAMPLE 1

The textile is a 12 foot wide carpet comprising backing material tufted with nylon yarn in a 12 foot width. This carpet is first treated with the following heated pre-wet solution in the pre-wet bath.

| | |
|---|---|
| 5.45 kg | "Pomoco JW" a tradename of Piedmont Chemical Industries, Inc., North Caroline which is a long, chain fatty alcohol amide with anionic surfactant. |
| 9.09 kg | "Chemcoloft 75-N" a tradename of a Chemical Processing of Georgia Company which is a fabric softener formed of a fatty imidazoline polyethylene emulsion. |
| 0.8 kg | "Quadafoam MA" which is a tradename for Quaker Chemical Corporation, North Carolina which is modified silicone base formed of silicone and chlorinated parafin used as a defoamer. |
| 0.8 kg | H-100 a tradename of WACO Chemical Company of Dalton, which is a chelating agent or water softener, comprising ethylene diamine tetra acetic acid (EDTA). |

The above ingredients are dissolved in sufficient water at a temperature of 135° F. to produce a 4000 lb. mixture having a pH of 7. This solution is placed in the pad machine 14. The carpet is run at 30 feet per minute through the pre-wet solution in the pad applicator with 30 lbs. per square inch of roller pressure on the pre-wetted carpet providing 140 percent pick-up of the pre-wet solution. The carpet tufts are then printed over spaced regions with the color 1 first dye.

| COLOR 1, PRINTER | |
|---|---|
| 4.09 kg | "Progowet FS" a tradename of the Chemical Process of Georgia Company which is an ethoxylated alcohol. |
| 4.08 kg | Formic Acid |
| 4.00 kg | Syngum D47D |
| 1.36 kg | Quadafoam MA |
| .018 kg | Acid Yellow 219 |
| .0174 kg | Acid Red 337 |
| .087 | Acid Blue 277 |
| | Tap Water |

The above ingredients are mixed with the tap water heated to room temperature to make a 3000 lb. mixture having a pH of 3 and a viscosity of 200 CPS.

A premeasured tank is filled about half-way with the heated tap water. The gum is added and then mixed. The remaining chemicals are then added with the acid added last. Water is then added to a predetermined level to produce the desired 3000 lbs. mixture. This mixture is then mixed for about 2 hours. A similar procedure is followed for the gum and dye mixtures described below.

| FIRST GUM, GUM APPLICATOR 42 | |
|---|---|
| 4.54 kg | Syngum D47D manufactured by the Steinhall Company or General Mills |
| 0.454 kg | Quadafoam MA |
| 0.454 kg | DXN a preservative, Dimethoxano |

-continued

| FIRST GUM, GUM APPLICATOR 42 | |
|---|---|
| .068 kg | Acetic Acid |

The above ingredients are mixed together with sufficient tap water at room temperature to provide a mixture having a viscosity of 1800 CPS and a pH of 5.5–6.

| COLOR 2, APPLICATOR 54 | |
|---|---|
| 2.72 kg | Progowet FS |
| 2.72 kg | Formic Acid |
| 5.6 kg | Syngum D47D |
| 0.4 kg | Quadafoam MA |
| 0.4 kg | H-100 |
| .030 kg | Acid Yellow 219 |
| .078 kg | Acid Red 337 |
| .900 kg | Acid Blue 277 |

The above ingredients are mixed with sufficient tap water at room temperature to produce a 2000 lb. mixture with a pH of 3 and a viscosity of 600 CPS. This mixture is applied to patterned areas in drop form.

| GUM 2, APPLICATOR 56 | |
|---|---|
| 2.72 kg | Progowet FS |
| 5.6 kg | Syngum D47D |
| 2.72 kg | Formic Acid |
| 0.4 kg | Quadafoam MA |
| 0.4 kg | H-100 |
| | Tap Water |

The above ingredients are mixed together with sufficient water at room temperature to make a 2000 lb. mixture having a pH of 3 and a viscosity of 600 CPS.

| COLOR 3, APPLICATOR 64 | |
|---|---|
| 8.16 kg | Formic Acid |
| 6.0 kg | Syngum D47D |
| 0.15 kg | Quadafoam MA |
| 0.60 kg | H-100 |
| .162 kg | Acid Yellow 199 |
| .192 kg | Acid Red 338 |
| 4.320 kg | Acid Blue 277 |

The above ingredients are mixed with sufficient tap water at room temperature to make a 6000 lb. mixture having a pH of 3 and a viscosity of 30 CPS. This mixture is applied to the entire carpet as a sheet. The carpet with the two gums and the three dyes are then transported while horizontal into the steamer unit for fixing the dyes to the tufts. The steamer unit is a three-pass unit in which in the second pass the carpet tufts are upside down.

EXAMPLE 2

The material is the same as in Example 1.

The pre-wet mixture has the same chemicals, pressure and speed as in Example 1 providing 140 percent pick-up. The mixture is heated to 135? F.

| COLOR 1, PRINTER | |
|---|---|
| .438 kg | Yellow 199 |
| .096 kg | Red 337 |
| .234 kg | Blue 277 |

The remaining ingredients are the same as in Example 1. The above ingredients are mixed with sufficient tap water at room temperature to make a 3000 lb. mixture having a viscosity of 200 CPS and a pH of 3.

GUM 1, APPLICATOR 42

Gum mixture is the same as Example 1.

| COLOR 2, APPLICATOR 54 | |
|---|---|
| 1.296 kg | Acid Yellow 199 |
| .152 kg | Acid Red 337 |
| .390 kg | Acid Blue 277 |

The remaining ingredients are the same as in Example 1.

The above ingredients are mixed together to make a mixture having a pH of 3 and a viscosity of 600 CPS.

GUM 2, APPLICATOR 56

The ingredients, pH and viscosity are the same as in Example 1.

| COLOR 3, APPLICATOR 64 | |
|---|---|
| 4.860 kg | Acid Yellow 199 |
| .972 | Acid Red 337 |
| 1.980 kg | Acid Blue 277 |

The remaining ingredients, pH and viscosity are the same as in Example 1.

EXAMPLE 3

The material is the same as in Example 1.

The pre-wet mixture has the same chemicals and pressure as in Example 1 with 140 percent pick-up. The mixture is heated to 135° F.

| COLOR 1, PRINTER | |
|---|---|
| .171 kg | Yellow 219 |
| .045 kg | Red 377 |
| .135 kg | Blue 277 |

The remaining ingredients are the same as in Example 1. The above ingredients are mixed with sufficient tap water at room temperature to make a mixture having a viscosity of 200 CPS and a pH of 3.

| COLOR 2, APPLICATOR 54 | |
|---|---|
| .360 kg | Acid Yellow 219 |
| .035 kg | Acid Red 337 |
| .420 kg | Acid Blue 277 |

The remaining ingredients are the same as in Example 1.

The above ingredients are mixed together to make a mixture having a pH of 3 and a viscosity of 600 CPS.

GUM 2, APPLICATOR 56

The ingredients, pH, and viscosity are the same as in the Example 1.

| COLOR 3, APPLICATOR 64 | |
|---|---|
| 2.016 kg | Acid Yellow 219 |
| .0234 kg | Acid Red 337 |

-continued

| COLOR 3, APPLICATOR 64 | |
|---|---|
| .2520 kg | Acid Blue 277 |

The remaining ingredients, pH and viscosity are the same as in Example 1.

Nylon carpeting dyed in the manner explained in the three examples above, exhibit multi-color hues with the dye colors produced by the print roller 30 and applicators 54 and separately visible on the finished product. There are variations in shadings ranging from the almost white, natural nylon color to a deep variation in the depth of color applied by applicator 64. The overall impression was that of a pleasing multi-hued effect.

It is to be understood that particular compositions or numbers of dyes used in the three examples above are not critical to the invention. While the dyes formulated in the examples above were made with a water base, it would be equally apparent that dyes with other bases having different viscosities could also yield similar effects. In all of the above examples the pH may be set to the desired value by adjusting the amount of acid added to amounts different than in the examples due to variations in pH in the water and the other elements added.

What is claimed is:

1. A continuous dyeing process for a tufted nylon textile material comprising:

first, applying a sheet of a first colorless aqueous gum solution at a first viscosity in the range of about 600–5000 CPS over the entire surface of the textile material;

second, applying a first aqueous acid dye solution at a second viscosity having a value of about one-third to two-thirds the value of the first viscosity to a first portion of said coated surface;

third, applying a second colorless aqueous gum solution at a third viscosity having a value of about one-third to two-thirds the value of the first viscosity to a second portion of said surface coated with said applied sheet;

fourth, applying a second aqueous acid dye solution at a fourth viscosity to a third portion of the textile material greater in area than and including said first and second portions, said second dye solution having a viscosity of roughly one-tenth or less than said second and third viscosities, so that the colors of said first and second dye solutions are separately visible on said textile material, said gum solutions and first dye solution effectively masking the textile material coated therewith from said second dye solution; and fifth, fixing the dyes of said first and second dye solutions to said textile material.

2. The process of claim 1 wherein said fixing step includes steaming said textile material with said surface facing up and then down, said steaming lowering the viscosity of said gum solutions to unmask some of said coated portions, said second dye solution diluting during said steaming and coloring some of said unmasked portions.

3. The process of claim 1 further including the steps of pre-wetting the textile material and then printing and compressing the material in a fourth portion with a third aqueous acid dye solution having a viscosity in the range of 50–1200 CPS, all of the above occurring prior to the steps of claim 1.

4. The process of claim 3 wherein the printed area has a wet pick-up of about 230–240 percent and the unprinted area has a wet pick-up of about 130–140 percent.

5. The process of claim 1 wherein said first viscosity is about 1800 CPS, said second and third viscosities are about 600 CPS, and said fourth viscosity is in the range of about 30–60 CPS.

6. A tufted nylon textile material dyeing process comprising:

wetting the textile material with a pre-wet solution;

squeezing a portion of the pre-wet solution from the textile material;

printing a pattern on the textile face with a first aqueous acid dye solution at a first viscosity of a value in a range of about 50 CPS–1200 CPS;

applying a layer of viscous colorless water soluble gum solution to the face of the textile material, said layer having a second viscosity in the range of about 600 to 5000 CPS;

transporting the coated wet textile material;

applying drops of a viscous water soluble second acid dye solution to the printed and coated wet face of the textile material during said transporting, said dye solution drops having a third viscosity in the range of about one-third to two-thirds the value of the second viscosity;

applying drops of a viscous, water soluble colorless gum solution to the coated and printed wet face of the textile material during the transporting, said drops of gum solution having a fourth viscosity of about the same as said third viscosity;

applying a layer of water soluble acid dye solution over said wet face during said transporting, said layer of water soluble dye solution having a fifth viscosity roughly about one-tenth or less than said third and fourth viscosities so as to be substantially masked by those portions of the textile material receiving said layer and drops of gum solution and first and second dye solutions; and steaming said textile material to fix the dyes of said solutions to said textile material and reduce the viscosity of said gum solutions.

7. The process of claim 6 wherein the ratio of said second viscosity to said third and fourth viscosities is about 3:1 and the ratio of said second viscosity to said fifth viscosity is about 60:1.

8. A nylon tufted carpet dyeing process comprising:

applying a layer of a first colorless aqueous gum liquid over the tufted face of the carpet, said layer having a first viscosity in the range of about 600–5000 CPS;

applying drops of a first aqueous acid dye solution randomly over the face of the layer coated carpet while still wet with said layer, said first dye solution having a second viscosity in the range of about one-third to two-thirds the viscosity of the gum liquid;

applying drops of a second colorless aqueous gum liquid soluble in said first liquid and first dye over the face of the carpet while wet with said layer and drops of first dye solution, said second liquid having a third viscosity in the range of about one-third to two-thirds the viscosity of the gum liquid layer;

applying a layer of a second aqueous acid dye solution to said carpet face while wet with said previously applied layer and drops, said second dye solution having a fourth viscosity of at most about ten percent the value of the viscosity of said second and third viscosities so that those tufts or portions thereof receiving either of the gum liquids or the first dye solution are substantially masked from said second dye solution;

fixing the dyes of said dye solutions to said carpet; and removing said gum liquids.

9. The process of claim 8 further including the steps of prewetting the carpet and then printing the carpet face over selected regions with a third aqueous acid dye solution having a viscosity in a range greater than the fourth viscosity and less than the second viscosity.

10. A method of dyeing a moving, nylon tufted-carpet web, in a continuous process comprising the steps of:

prewetting the carpet web in a solution which relaxes the tufts so that when they are compressed during the following printing step, they tend to retain their compressed condition;

printing a pattern with a first aqueous acid dye solution of a first dye color on the tufted surface of the moving carpet web, compressing the tufts which receive the dye solution;

after the printing step above, applying a sheet of a viscous first aqueous gum solution having a viscosity in the range of 600–5000 CPS over the entire tufted surface of the moving web while the web is substantially horizontal;

applying drops of a second aqueous acid dye solution to the gum wetted surface of the moving carpet web, the second dye solution having a viscosity in the range of about one-third to two-thirds of the gum solution viscosity;

after the step above, applying drops of a second colorless aqueous gum solution, which has a viscosity in the range of about one-third to two-thirds of the gum solution viscosity to the tufted surface of the moving carpet web;

then flooding the tufted surface of the moving carpet web with a third aqueous acid dye solution having a viscosity of roughly about one-tenth or less than the second dye solution viscosity such that the carpet tufts or portions thereof receiving either of the gum solutions or the second dye solution are substantially masked from said third dye solution; and then steaming the carpet.

11. The method as set forth in claim 10 wherein the carpet is steamed first while the tufted surface of the moving web faces up and then while the tufted surface of the moving web faces down.

12. The method as set forth in claim 10 wherein said first dye has a viscosity of about 200 CPS, said first gum has a viscosity of about 1800 CPS, said second gum and dye have viscosities in the range of 600–1200 CPS and said third dye has a viscosity in the range of 30–60 CPS.

* * * * *